US008822802B1

(12) United States Patent
McGillivary

(10) Patent No.: US 8,822,802 B1
(45) Date of Patent: Sep. 2, 2014

(54) SYSTEM AND METHOD FOR GENERATING MUSICAL DISTORTION IN AN AUDIO AMPLIFIER

(76) Inventor: James Mark McGillivary, Portland, OR (US)

( * ) Notice: Subject to any disclaimer, the term of this patent is extended or adjusted under 35 U.S.C. 154(b) by 315 days.

(21) Appl. No.: 13/206,406

(22) Filed: Aug. 9, 2011

Related U.S. Application Data

(60) Provisional application No. 61/501,104, filed on Jun. 24, 2011.

(51) Int. Cl.
*G10H 1/08* (2006.01)

(52) U.S. Cl.
USPC ..... 84/626; 84/622; 84/633; 84/662; 84/665

(58) Field of Classification Search
None
See application file for complete search history.

(56) References Cited

U.S. PATENT DOCUMENTS

| | | | | | |
|---|---|---|---|---|---|
| 4,120,229 | A | * | 10/1978 | Ota | 84/454 |
| 4,320,534 | A | * | 3/1982 | Sakai et al. | 455/267 |
| 4,457,203 | A | * | 7/1984 | Schoenberg et al. | 84/454 |
| 4,592,069 | A | * | 5/1986 | Redding | 375/222 |
| 4,916,409 | A | * | 4/1990 | Tracy | 330/294 |
| 5,007,324 | A | * | 4/1991 | DeMichele | 84/741 |
| 5,636,284 | A | | 6/1997 | Pritchard | |
| 5,734,725 | A | | 3/1998 | Pritchard | |
| 5,761,316 | A | | 6/1998 | Pritchard | |
| 5,761,317 | A | | 6/1998 | Pritchard | |
| 5,805,713 | A | | 9/1998 | Pritchard | |
| 5,848,165 | A | | 12/1998 | Pritchard | |
| 5,936,470 | A | * | 8/1999 | Stroud | 330/284 |
| 6,204,735 | B1 | * | 3/2001 | Cairns | 332/119 |
| 7,061,740 | B2 | * | 6/2006 | Mendenhall | 361/93.1 |
| 7,245,886 | B2 | * | 7/2007 | Sorrells et al. | 455/118 |
| 7,683,710 | B2 | | 3/2010 | Arnold | |
| 7,855,598 | B2 | | 12/2010 | Arnold | |
| 7,932,458 | B2 | | 4/2011 | Arnold | |
| 7,957,539 | B2 | * | 6/2011 | Packard | 381/61 |
| 8,013,675 | B2 | * | 9/2011 | Rawlins et al. | 330/147 |
| 8,446,994 | B2 | * | 5/2013 | Rawlins et al. | 375/345 |
| 8,502,600 | B2 | * | 8/2013 | Rawlins et al. | 330/147 |
| 8,542,848 | B1 | * | 9/2013 | Krutsick | 381/118 |
| 2006/0126851 | A1 | * | 6/2006 | Yuen et al. | 381/1 |

* cited by examiner

*Primary Examiner* — Marlon Fletcher
(74) *Attorney, Agent, or Firm* — Booth Udall Fuller, PLC

(57) ABSTRACT

A guitar amplifier system is disclosed. Specific implementations for the guitar amplifier system may comprise an audio input for an audio signal, a preamplifier coupled to the audio input, a tone control element coupled to the preamplifier, a power amplifier coupled to the tone control element, and an audio output coupled to the power amplifier. In an implementation, the tone control may be configured to control at least one of sound equalization, compression distortion, chorus or reverb. In an implementation, at least one of the preamplifier and the power amplifier may comprise at least one distortion multiplier circuit. The distortion multiplier circuit may comprise an audio signal multiplier configured to amplify an audio signal and output an amplified audio signal. The distortion multiplier circuit may also comprise a first voltage clamping circuit between a Vhigh preset level and a reference node coupled to the field effect transistor drain, and a second voltage clamping circuit between the Vlow preset level and the reference node. The Vhigh preset level and Vlow preset level may be set at different distances from a center voltage to asymmetrically distort the audio signal through asymmetrically limiting gain of the audio signal above the preset level and when compared with below the preset level. The distortion multiplier circuit may also comprise a blocking element configured to block DC biases of the field effect transistor.

26 Claims, 6 Drawing Sheets

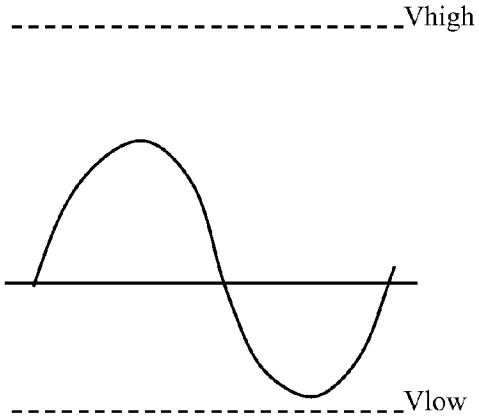
FIG. 5A
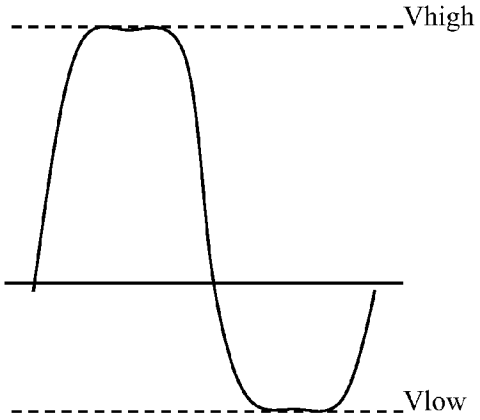
FIG. 5C
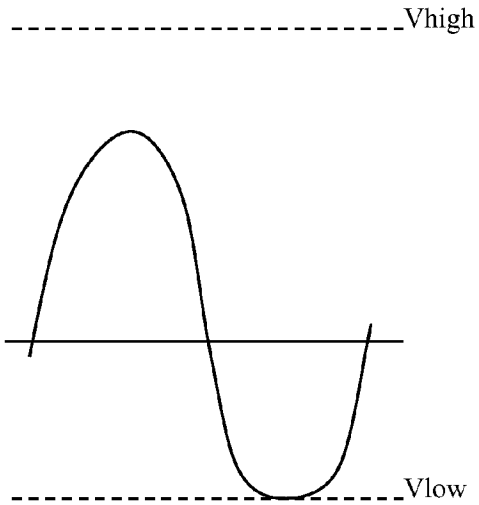
FIG. 5B
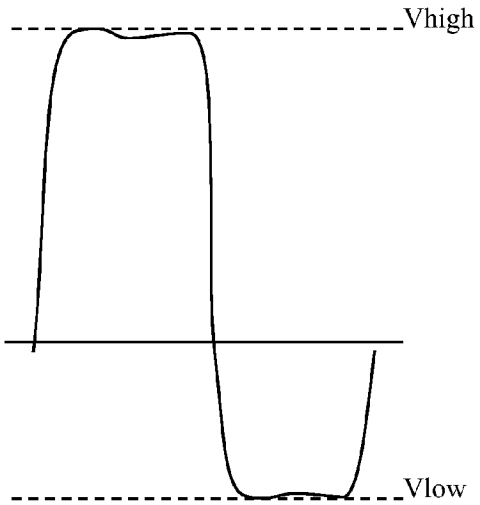
FIG. 5D
FIG. 5

SYSTEM AND METHOD FOR GENERATING MUSICAL DISTORTION IN AN AUDIO AMPLIFIER

CROSS REFERENCE TO RELATED APPLICATIONS

This document claims the benefit of the filing date of U.S. Provisional Patent Application 61/501,104, entitled "A Novel Method of Generating Musical Distortion in a Guitar Amplifier" to James Mark McGillivary which was filed on Aug. 9, 2010, the contents of which are hereby incorporated herein by reference.

BACKGROUND

1. Technical Field

Aspects of this document relate generally to audio amplifiers.

2. Background Art

The requirements of a modern guitar amplifier are to be able to operate in two modes: a "clean" mode and an "overdrive" mode. In a clean mode, the amplifier passes the signal from the guitar with minimal changes or distortion. In an overdrive mode, the amplifier intentionally creates harmonic distortion from the signal to create classic rock or heavy metal sounds. Overdrive mode originated in vacuum tube amplifiers, which have an ability to gracefully enter and exit from the overload zone. Most transistors and transistor amplifiers abruptly distort and take time to recover, resulting in an inferior sound. Some complicated transistor amplifiers have been able to replicate parts of the vacuum tube sound, but are unable to do both "clean" and "overdrive" with a smooth transition between them.

SUMMARY

A guitar amplifier system may comprise an audio input for an audio signal, a preamplifier coupled to the audio input, a tone control element coupled to the preamplifier, a power amplifier coupled to the tone control element, and an audio output coupled to the power amplifier.

In one aspect, the tone control element may be configured to control at least one of sound equalization, compression, distortion, chorus, or reverb.

In one aspect, at least one of the preamplifier and the power amplifier may comprise at least on distortion multiplier circuit. The distortion multiplier circuit may comprise an audio signal multiplier, a first and a second voltage clamping circuit, and a blocking element. In one aspect, the audio signal multiplier may be configured to amplify an audio signal and output an amplified audio signal.

In one aspect the first voltage clamping circuit may be between a Vhigh preset level and a reference node coupled to an output of the audio signal multiplier. The second voltage clamping circuit may be between the Vlow preset level and the reference node. The Vhigh preset level and Vlow preset level may be set at different distances from a center voltage and asymmetrically distort the audio signal through asymmetrically limiting a gain of the audio signal above the Vhigh preset level when compared with below the Vlow preset level.

In one aspect, the blocking element may be configured to block DC biases of the audio signal multiplier.

For particular implementations, the audio signal multiplier may comprise a transistor. For other particular implementations, the transistor may comprise a field effect transistor. For still other particular implementations, the guitar amplifier system may also comprise a first resistor coupled between a source terminal and a first reference voltage, a second resistor coupled between a drain and a second reference voltage, and a third resistor coupled between a gate terminal and a third reference voltage.

For particular implementations, the first and second voltage clamping circuits may each comprise a diode. For other particular implementations, the diodes may comprise light emitting diodes (LEDs).

For particular implementations, the Vhigh and Vlow preset levels may be preset in the amplifier when the amplifier is manufactured. For other particular implementations, the Vhigh and Vlow preset levels may be preset by a user before the audio signal is transmitted through the amplifier system. For still other implementations, the Vhigh and Vlow preset levels are preset by a user adjusting one or more controls on a housing of the amplifier system. For other implementations, the Vhigh and Vlow preset levels may be adjusted by a user while the audio signal is transmitted through the amplifier system.

For particular implementations, the at least one distortion multiplier circuit may comprise a plurality of cascading distortion multiplier circuits. For particular implementations, the plurality of cascading distortion multiplier circuits may comprise four cascading distortion multiplier circuits each comprising substantially the same components.

For particular implementations, the blocking element may comprise a capacitor.

A multiplier circuit for a guitar amplifier may comprise a circuit input configured to receive an audio signal, an audio signal multiplier configured to amplify an audio signal and output an amplified audio signal, a first and a second voltage clamping circuit, a blocking element configured to block DC biases of the audio signal multiplier, and a circuit output configured to transmit the audio signal.

In one aspect, the first voltage clamping circuit may be between a Vhigh preset level and a reference node coupled to an output of the audio signal multiplier. The second voltage clamping circuit may be between a Vlow preset level and the reference node. In one aspect, the Vhigh preset level and the Vlow preset level are set at different distances from a center voltage to asymmetrically distort the audio signal through asymmetrically limiting a gain of the audio signal above the Vhigh preset level and when compared with below the Vlow preset level.

For particular implementations, the audio signal multiplier may comprise a transistor. For other particular implementations, the transistor may comprise a field effect transistor. For still other implementations, the multiplier circuit may comprise a first resistor coupled between a source terminal and a first reference voltage, a second resistor coupled between a drain terminal and a second reference voltage, and a third resistor coupled between a gate terminal and a third reference voltage.

For particular implementations, the Vhigh and Vlow preset levels are preset in the circuit when the amplifier is manufactured. For other particular implementations, the Vhigh and Vlow preset levels are preset by a user before the audio signal is transmitted through the amplifier system. In still other particular implementations, the Vhigh and Vlow preset levels are adjusted by a user while the audio signal is transmitted through the amplifier system.

For particular implementations, the distortion multiplier may be coupled in series with at least one additional distortion multiplier circuit. In other particular implementations, the at least one additional distortion multiplier circuit comprises three additional cascading distortion multiplier circuits.

For particular implementations, the first and second voltage clamping circuits may comprise diodes. For other particular implementations, the diodes may comprise LEDs.

A method of intentionally distorting an audio signal may comprise receiving an audio signal at a first node, increasing a gain of the audio signal, setting an asymmetrical clipping limit on the gain, asymmetrically clipping off portions of the audio signal, and outputting the audio signal.

In one aspect, increasing a gain of the audio signal may comprise increasing a gain of the audio signal through a multiplier circuit comprising an output.

In one aspect, setting an asymmetrical clipping limit on the gain may comprise setting an asymmetrical clipping limit between a preset Vhigh and Vlow.

In one aspect, asymmetrically clipping off portions of the audio signal may comprise asymmetrically clipping above an upper limit determined by Vhigh with a first voltage clamping circuit coupled between the output and Vhigh. Asymmetrically clipping may comprise asymmetrically clipping below a lower limit determined by Vlow with a second voltage clamping circuit coupled between the output and Vlow.

In one aspect, outputting the audio signal may comprise outputting the signal with portions of the audio signal above the upper limit distorted and below the lower limit distorted.

For particular implementations, the method of intentionally distorting an audio signal may also comprise presetting the Vhigh and Vlow when the audio multiplier circuit is manufactured. For other particular implementations, the method of intentionally distorting an audio signal may also comprise presetting the Vhigh and Vlow before receiving the audio signal at the first node.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and:

FIG. 5 is a graph of various sine waves with different distortions; and

DESCRIPTION

This disclosure, its aspects and implementations, are not limited to the specific components or assembly procedures disclosed herein. Many additional components and assembly procedures known in the art consistent with the intended amplifier and/or assembly procedures for an amplifier will become apparent for use with implementations of the amplifier from this disclosure. Accordingly, for example, although particular amplifiers are disclosed, such amplifiers and implementing components may comprise any shape, size, style, type, model, version, measurement, concentration, material, quantity, and/or the like as is known in the art for such amplifiers and implementing components, consistent with the intended operation of an amplifier.

Figure 1:
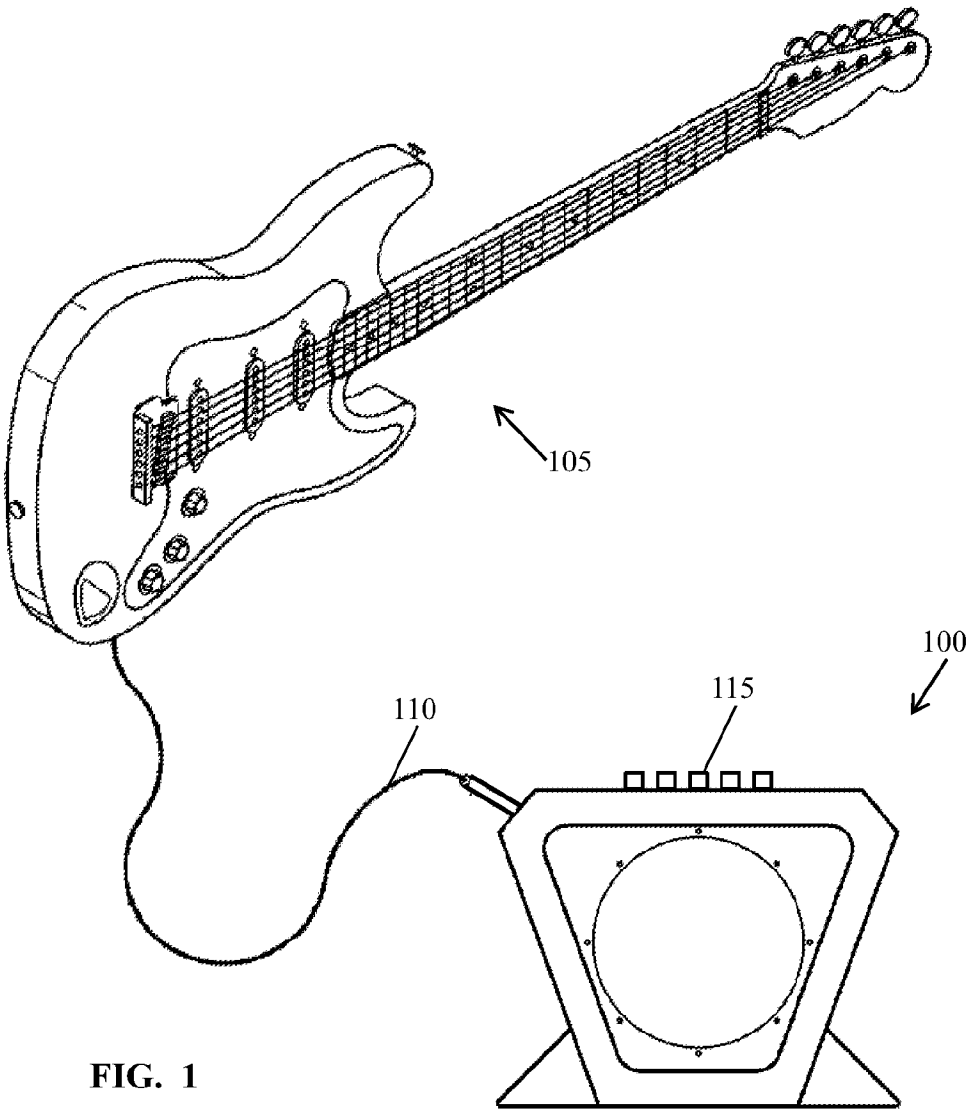
FIG. 1 is a perspective view of an electric guitar hooked up to a guitar amplifier.

In FIG. 1, an implementation of an amplifier 100 coupled with an electric guitar 105 is shown. In an implementation, the amplifier 100 is designed to amplify the audio signal from the electric guitar 105. In other implementations, the amplifier 100 may be designed to amplify any audio signal, such as, but not limited to, an audio signal from any musical instrument or voice. In the implementation of FIG. 1, an audio signal is transmitted from the guitar 105 through a cord 110 coupled to a side of the amplifier 100. In other implementations, the guitar 105 or other source of the audio signal may send the audio signal to the amplifier 100 through any variety of mechanisms, including but not limited to any type of cord or cable, wireless transmission, and the like.

The amplifier 100 may further comprise any number of knobs 115 for controlling various qualities of the sound amplified by the amplifier. For example, various implementations may comprise a knob for various tone controls such as but not limited to equalization of specific pitches or frequencies in the signal softer or louder. The knobs 115 may further comprise at least one knob for adjust the Vhigh and Vlow of circuits in the amplifier, thus providing the user or musician the ability to manipulate distortion of the audio signal as further described herein. The knobs 115 may be replaced or used in combination with other buttons, levers, touch screen devices, or any other mechanisms for adjusting tone control, volume, Vhigh/Vlow, and the like.

Figure 2:
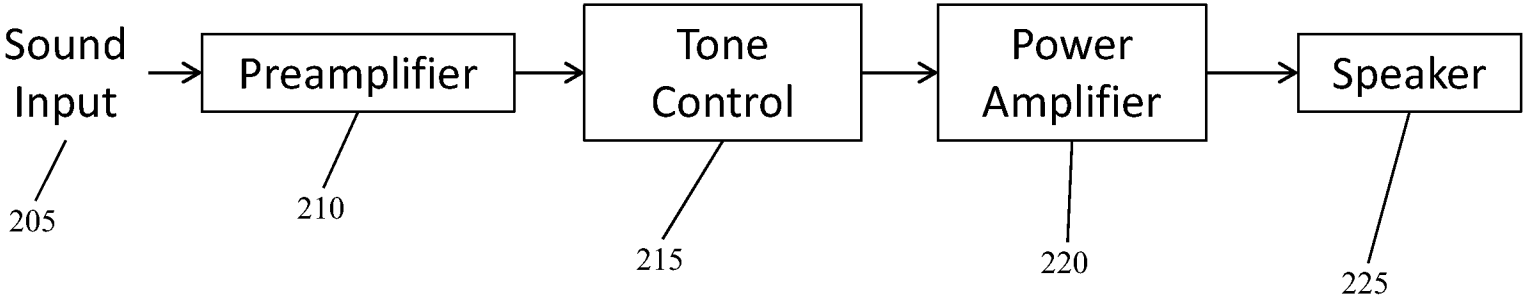
FIG. 2 is a block diagram of a system for distorting an audio signal through an amplifier.

In FIG. 2, a block diagram of a basic example for a particular implementation of a system for distorting sound through an amplifier system is shown. In the system shown, an audio input 205 may be entered into the system. The audio input may come from a cord connected directly to a musical instrument, through a microphone connected to the amplifier, or through any variety of mechanisms for inputting an audio signal into an amplifier.

The particular implementation of the system illustrated in FIG. 2 may further comprise a preamplifier 210. The preamplifier 210 may comprise any amplifier that prepares the audio input for further amplification or processing. The preamplifier 210 may boost the signal strength without significantly degrading the signal-to-noise ratio. In various implementations, the preamplifier 210 may be incorporated into the housing or chassis of the main amplifier, in a separate housing, or mounted within or near the signal source. The preamplifier 210 may further comprise a single or plurality of cascading circuits for amplifying the audio input, as described in detail in relation to FIGS. 3 and 4, below. Alternatively other amplifying or additional amplifying circuits may be used.

The particular implementation of the system illustrated in FIG. 2 may further comprise a tone control 215. The tone control 215 may be used to make specific pitches or frequencies in the signal softer or louder or to change other audio characteristics of the audio signal. The tone control 215 may comprise a tone control circuit that modifies the signal before the signal passes to speakers, headphones, recording devices, or other amplifiers.

The particular implementation of the system illustrated in FIG. 2 may further comprise a power amplifier 220. The power amplifier 220 may increase the power of the signal. The power amplifier may comprise any variety or number of amplifying circuits, including those depicted in FIGS. 3 and 4.

The particular implementation of the system illustrated in FIG. 2 may further comprise at least one speaker 225. The speaker may comprise any electroacoustic transducer that produces sound in response to the audio signal. The speaker may further comprise any speaker type or design commonly known to those skilled in the art, such as but not limited to dynamic loudspeakers, subwoofers, woofers, mid-range drivers, tweeters, and the like. Furthermore, some implementations may comprise a wireless speaker with an amplifier integrated into the speaker's housing.

Figure 3:
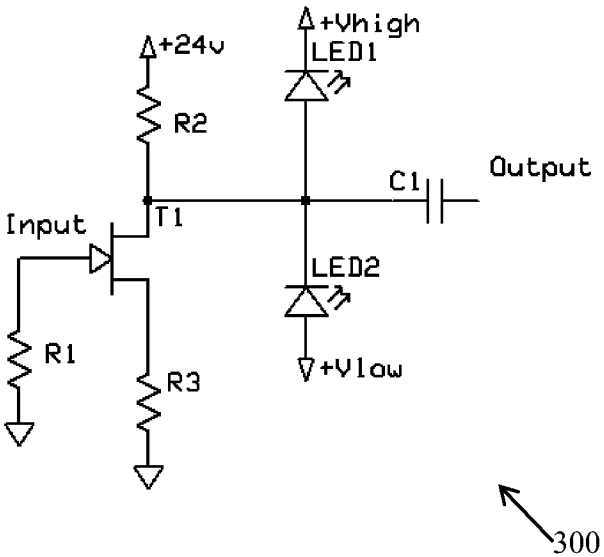
FIG. 3 is a diagram of a single-circuit amplifier in a guitar amplifier.

In FIG. 3, a diagram for a particular implementation of a single-circuit 300 amplifier for a guitar amplifier is shown. In this circuit, the Input comprises a signal from a guitar. In other implementations, the Input may comprise any audio signal (which includes any signal representing an audio signal including any digital or analog audio signal). The implementation further comprises an audio signal multiplier configured to multiply an audio signal and output an amplified audio signal. In particular implementations, the audio signal multiplier may comprise any type of transistor, such as, but not limited to, a field effect transistor T1. In the implementation shown, transistor T1 is a junction gate field-effect transistor (JFET), while in other implementations, T1 may comprise any type of transistor or other amplifying circuit such as an Op-amp. In the single-circuit 300 of FIG. 3, T1, in combination with the respective resistors R1, R2 and R3, amplifies the signal and outputs the signal at the drain of T1. The single-circuit may further comprise any element to block the DC biases, such as a capacitor C1. In FIG. 3, capacitor C1 blocks the DC biases of T1 and couples the amplified signal to the next stage in the amplifier.

The single-circuit 300 may further comprise one or more voltage clamping circuits to distort the amplified signal. In various implementations, the single-circuit 300 may comprise any type of voltage clamping circuit, such as, but not limited to, one or more diodes. In the implementation of FIG. 3, the single-circuit comprises two light-emitting diodes (LED), shown as LED1 and LED2. In other implementations, the single-circuit 300 may comprise any type and any number of diodes. For the use of LEDs as clipping diodes, the non-linear zone where the LEDs begin turning on is much broader than with standard diodes. For example, standard diodes typically turn on from 0.0v to 0.7v. In contrast, LEDs span 0.0v to 2.0v. This broader non-linear zone associated with LEDs allows for a smoother transition into and out of distortion for the audio signal, as well as visual feedback to the musician. The LEDs may, in some implementations, signal to the musician when the amp is distorting or what stage of a multi-stage amplifier is distorting. The use of LEDs is sometimes avoided in other amplifiers because LEDs typically have a low reverse breakdown voltage, which may damage the LED. Since JFET amplifiers are extremely low noise, a very high gain, low noise amplifier may be made by stringing many of these circuits together in a series (as shown in FIG. 4).

When the signal is at a small or low enough signal gain strength, LED 1 and LED2 are both turned off and there is no distortion of the audio signal. As the signal increases, either LED1 or LED2, or both LED1 and LED2 turn on and begin to divert current from T1. The activation of LED1 and LED2 may be at a manually set level dependent upon the user's preferences, or may be automatic. As the current is diverted from T1, the gain of the T1 is gently turned down well before T1 is saturated. If T1 is allowed to saturate, then an abrupt and harsh sound would result. Furthermore, if T1 is allowed to saturate, then it takes a short period of time to recover that can cause a noticeable drop in volume during rapid note playing as the amplifier recovers, making the effect very noticeable and inconsistent with the music being played. As the musician plays music harder (and resultantly louder), the audio signal volume and magnitude increases. As the signal increases, LED1 and LED2 eventually are both completely activated or turned on. When completely turned on, LED1 clips the signal peak at $V_{high}$+2.0v and LED2 clips the signal peak at $V_{low}$ −2.0v. In other implementations, $V_{high}$ and $V_{low}$ may be set to any voltage. Sometimes the voltage may be set the same, at other times the voltages may be set differently. In some implementations, the user is provided with separate controls, allowing the user to control the distortion of the output. If the musician plays softer, the audio signal magnitude decreases and the circuit quickly returns to a non-distorted, clean mode.

Because the amplifier comprises two different diodes, two different voltages may be utilized: $V_{high}$ and $V_{low}$. These two voltages allow the amplifier designer, user, or musician an increased level of control over the music distortion. In particular implementations, T1 is biased to have the Vsource at approximately 12V DC. The audio signal may then be modeled as a sine wave centered at 12V. To distort the audio signal more frequently, $V_{high}$ and $V_{low}$ may both be set very close to the 12V. The amplifier designer, user, or musician may also set one of the $V_{high}$ or $V_{low}$ close to the 12V DC point and the other farther away. Such a setting would result in an asymmetrical distortion where one half of the signal distorts much earlier than the other half.

Figure 4:
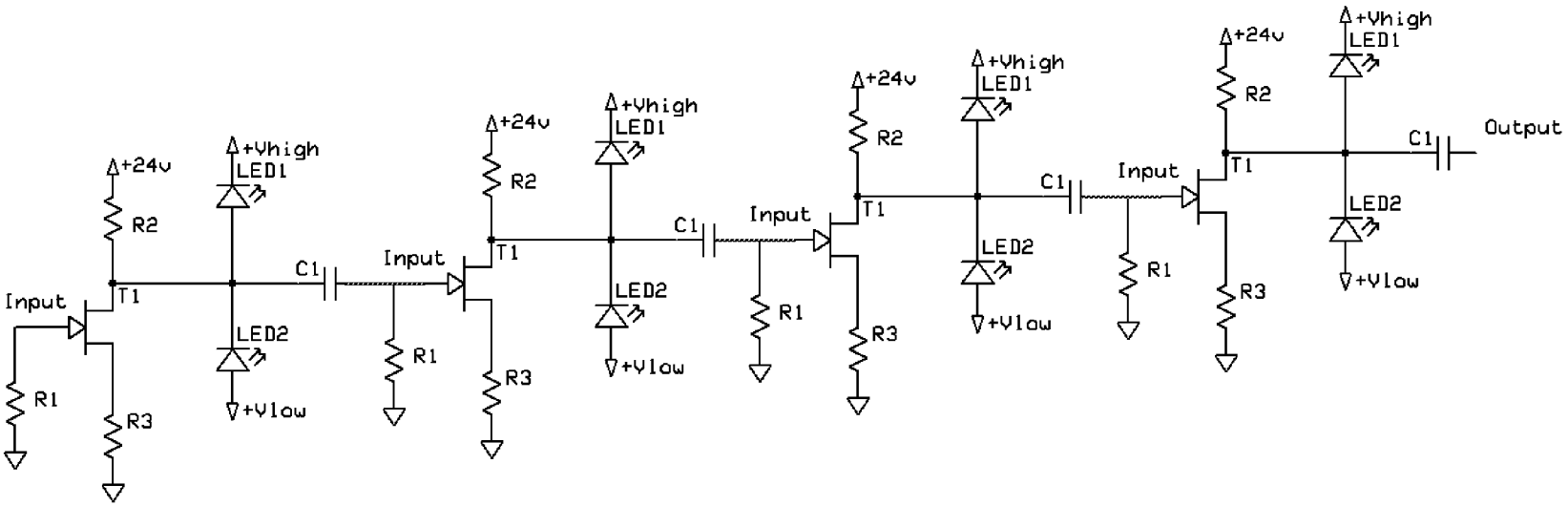
FIG. 4 is a diagram of a four-circuit amplifier in a guitar amplifier.

FIG. 4 illustrates a diagram for a cascading four-circuit amplifier for a guitar amplifier is shown. The single-circuit amplifier or an amplifier with multiple cascaded circuits may be included within any amplifier circuit within the amplifier system. In various implementations, the guitar amplifier may comprise any number of circuits in a cascading circuit series. Each of the circuits diagramed in FIG. 4 function similar to the function described in relation to the single-circuit amplifier of FIG. 3. In a multi-circuited amplifier, however, the Input for the second circuit through the last circuit comprises the output of the preceding circuit. Therefore, each audio signal may be amplified or distorted at each circuit of the cascading series of circuits. For example, if the first circuit in the circuit series distorts the audio signal asymmetrically, the second circuit will further distort that distortion, and so on. Each circuit may comprise a multiplier circuit, or any other circuit configured to amplify and distort sound.

FIG. 5 illustrates sound waves for the audio signal shown at various levels and settings of an audio signal distortion circuit of an amplifier system. In each of FIGS. 5A-D, the Vhigh and Vlow are set at asymmetrical presets, meaning the distances of Vhigh and Vlow from the reference voltage around which the sine wave is centered are not equal. In FIG. 5A, an undistorted music tone is shown. In an undistorted music tone, the volume level has not reached either the Vhigh or the Vlow clamping voltage presets and thus still looks like a regular sine wave. In FIG. 5B, a partially distorted music tone is shown. As the music is played louder or harder, the sound waves increase in magnitude. Here, one side of the music tone, the lower side, is distorting when the bottom of the sound wave hits the Vlow clamping voltage. When the wave reaches the Vlow preset level, the wave is clipped at the Vlow preset level. This clipping creates a smooth beginning of distortion and even harmonics.

In FIG. 5C, both the top and bottom of the wave are clipped, but the wave remains asymmetrical. This asymmetric clipping is a result of the different distances of Vhigh and Vlow from the reference voltage around which the original sine wave is centered. As both the top and bottom of the wave are clipped, even more distortion occurs and odd harmonics are added to the already present even harmonics. In FIG. 5D, both the top and the bottom of the wave remain clipped. However, as the wave increases in size and more of the wave is clipped, the wave approaches a square wave form. In a particular implementation, this level of distortion may result from multiple stages of circuits in a cascading circuit, wherein each circuit feeds the next circuit a distorted waveform, creating more and more distortion. The signal multiplication of each stage relative to the settings for each stage and the Vhigh and Vlow settings will also affect the resulting distortion effect. Those of ordinary skill in the art and musical quality will readily understand how to implement an appropriate number and character for the one or more amplification circuits.

Figure 6:
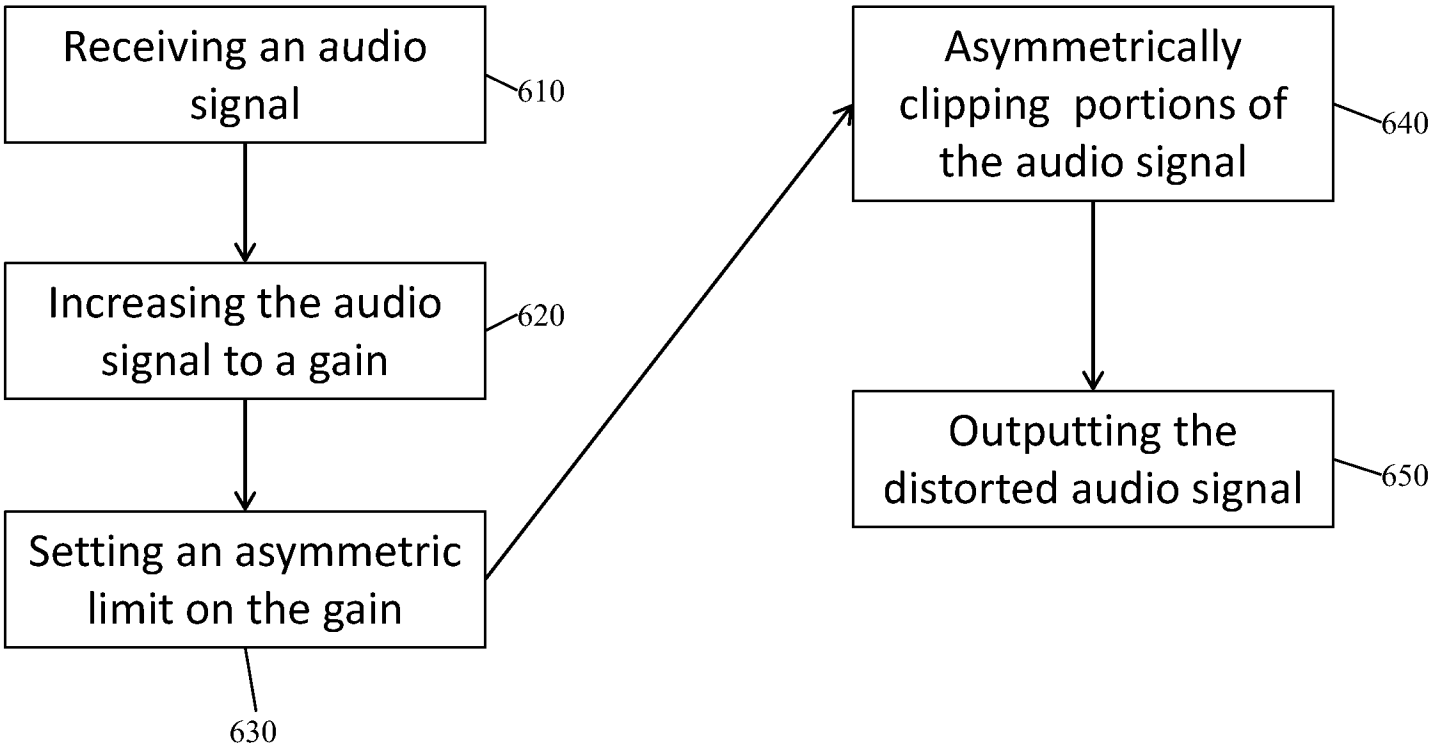
FIG. 6 is a flow diagram of a method for distorting an audio signal.

In FIG. 6, a flow diagram for a method of intentionally distorting an audio signal is shown. In various implementations, the method may comprise receiving an audio signal 610. The audio signal may be created by any variety of musical instruments or voices. Transmission of the audio signal may be through a variety of mechanisms, such as but not limited to any appropriate cord, cable, or wireless transmission. Reception of the audio signal may comprise reception of the audio signal at an appropriately configured amplifier. The node may further comprise an element within the amplifier after audio signal has been received by a cord or cable jack, or wireless receiver.

The method may further comprise increasing the audio signal to a gain 620 by, for example, playing the musical instrument louder, harder, or may comprise increasing the audio signal by increasing the gain control of the circuit amplifiers. Any circuits described in relation to FIG. 3 or 4 may be used in the method to amplify the audio signal.

The method may further comprise setting an asymmetric limit on the gain 630. The asymmetric limit may be set in the amplifier at the time of manufacture or may be set by the user or musician before the audio signal is transmitted to the amplifier. The user or musician may also, in some implementations, set the asymmetric limit while the audio signal is being distorted by the amplifier. The asymmetric limit may result from any asymmetric Vhighs or Vlow presets. For example, the Vhigh may be set at +2.0V and the Vlow set at −1.0V.

The method may further comprise asymmetrically clipping portions of the audio signal 640. In various implementations, the audio signal is clipped above an upper limit set by the Vhigh and below a lower limit set by the Vlow. In various implementations, a voltage clamping circuit, such as a diode may be used to clip the audio signal. Because the upper and lower limits are intentionally set asymmetrically, in some circumstances, only one of the bottom or the top of the wave may be clipped. In such circumstances, partial distortion and even harmonics are accomplished. In other circumstances, both the top and the bottom of the wave may be clipped, adding more distortion and odd harmonics to the previously created even harmonics.

The method may further comprise outputting the distorted audio signal 650. In some implementations, outputting the distorted audio signal 650 may comprise outputting the audio signal with portions of the audio signal distorted above the upper limit and below the lower limit. The output of the audio signal may be in conjunction or combination with a speaker either within or outside the housing of the amplifier.

Other implementations of the method of intentionally distorting an audio signal may comprise transmitting the audio signal through a preamplifier, transmitting the signal through a power amplifier, or controlling the tone of the audio signal with a tone controller. In still other implementations, the method may comprise presetting the Vhigh and Vlow at various points in time, such as but not limited to during manufacture, just before playing or use, or during playing or use.

It will be understood that implementations are not limited to the specific components disclosed herein, as virtually any components consistent with the intended operation of a method and/or system implementation for an amplifier may be utilized. Accordingly, for example, although particular circuits, diodes, or amplifiers may be disclosed, such components may comprise any shape, size, style, type, model, version, class, grade, measurement, concentration, material, weight, quantity, and/or the like consistent with the intended operation of a method and/or system implementation for an amplifier may be used.

In places where the description above refers to particular implementations of an amplifier, it should be readily apparent that a number of modifications may be made without departing from the spirit thereof and that these implementations may be applied to other amplifiers. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A guitar amplifier system, comprising:
- an audio input for an audio signal;
- a preamplifier coupled to the audio input;
- a tone control element coupled to the preamplifier and configured to control at least one of sound equalization, compression, distortion, chorus, or reverb;
- a power amplifier coupled to the tone control element;
- an audio output coupled to the power amplifier; and
- wherein at least one of the preamplifier and the power amplifier comprises at least one distortion multiplier circuit comprising:
  - an audio signal multiplier configured to amplify an audio signal and output an amplified audio signal;
  - a first voltage clamping circuit between a Vhigh preset level and a reference node coupled to an output of the audio signal multiplier, and a second voltage clamping circuit between the Vlow preset level and the reference node, wherein the Vhigh preset level and the Vlow preset level are set at different distances from a center voltage and asymmetrically distort the audio signal through asymmetrically limiting a gain of the audio signal above the Vhigh preset level and when compared with below the Vlow preset level; and
  - a blocking element configured to block DC biases of the audio signal multiplier.

2. The guitar amplifier system of claim 1, wherein the audio signal multiplier comprises a transistor.

3. The guitar amplifier system of claim 2, wherein the transistor comprises a field effect transistor.

4. The guitar amplifier system of claim 3, further comprising:
- a first resistor coupled between a source terminal and a first reference voltage;
- a second resistor coupled between a drain and a second reference voltage; and
- a third resistor coupled between a gate terminal and a third reference voltage.

5. The guitar amplifier system of claim 4, wherein the first voltage clamping circuit comprises a first diode and the second voltage clamping circuit comprises a second diode.

6. The guitar amplifier system of claim 5, wherein the first diode comprises a first light emitting diode and the second diode comprises a second light emitting diode.

7. The guitar amplifier system of claim 1, wherein the Vhigh preset level and Vlow preset level are preset in the amplifier when the amplifier system is manufactured.

8. The guitar amplifier system of claim 1, wherein the Vhigh preset level and Vlow preset level are preset by a user before the audio signal is transmitted through the amplifier system.

9. The guitar amplifier system of claim 8, wherein the Vhigh preset level and Vlow preset level are preset by a user comprises the user adjusting one or more controls on a housing of the amplifier system.

10. The guitar amplifier system of claim 1, wherein the Vhigh preset level and Vlow preset level are adjusted by a user while the audio signal is transmitted through the amplifier system.

11. The guitar amplifier system of claim 1, wherein the at least one distortion multiplier circuit comprises a plurality of cascading distortion multiplier circuits.

12. The guitar amplifier system of claim 11, wherein the plurality of cascading distortion multiplier circuits comprises four cascading distortion multiplier circuits each comprising substantially the same components.

13. The guitar amplifier system of claim 1, wherein the blocking element comprises a capacitor.

14. The guitar amplifier system of claim 1, wherein the first voltage clamping circuit comprises a first diode and the second voltage clamping circuit comprises a second diode.

15. The guitar amplifier system of claim 14, wherein the first diode comprises a first light emitting diode and the second diode comprises a second light emitting diode.

16. A multiplier circuit for a guitar amplifier, comprising:

a circuit input;

an audio signal multiplier configured to amplify an audio signal and output an amplified audio signal;

a first voltage clamping circuit between a Vhigh preset level and a reference node coupled to an output of the audio signal multiplier, and a second voltage clamping circuit between a Vlow preset level and the reference node, wherein the Vhigh preset level and the Vlow preset level are set at different distances from a center voltage and asymmetrically distort the audio signal through asymmetrically limiting a gain of the audio signal above the Vhigh preset level and when compared with below the Vlow preset level;

a blocking element configured to block DC biases of the audio signal multiplier; and a circuit output.

17. The multiplier circuit of claim 16, wherein the audio signal multiplier comprises a transistor.

18. The multiplier circuit of claim 17, wherein the transistor comprises a field effect transistor.

19. The multiplier circuit of claim 18, further comprising:

a first resistor coupled between a source terminal and a first reference voltage;

a second resistor coupled between a drain terminal and a second reference voltage; and a third resistor coupled between a gate terminal and a third reference voltage.

20. The multiplier circuit of claim 16, wherein the Vhigh preset level and Vlow preset level are preset in the circuit when the amplifier system is manufactured.

21. The multiplier circuit of claim 16, wherein the Vhigh preset level and Vlow preset level are preset by a user before the audio signal is transmitted through the amplifier system.

22. The multiplier circuit of claim 16, wherein the Vhigh preset level and Vlow preset level are adjusted by a user while the audio signal is transmitted through the amplifier system.

23. The multiplier circuit of claim 16, wherein the distortion multiplier circuit is coupled in series with at least one additional distortion multiplier circuit.

24. The multiplier circuit of claim 23, wherein the at least one additional distortion multiplier circuit comprises three additional cascading distortion multiplier circuits.

25. The multiplier circuit of claim 16, wherein the first voltage clamping circuit comprises a first diode and the second voltage clamping circuit comprises a second diode.

26. The multiplier circuit of claim 25, wherein the first diode comprises a first light emitting diode and the second diode comprises a second light emitting diode.

* * * * *